United States Patent [19]

DeCaro et al.

[11] 4,145,630

[45] Mar. 20, 1979

[54] HALOGEN-CYCLE TYPE INCANDESCENT LAMP

[75] Inventors: Aristide R. DeCaro, Edison; Nicholas J. Rainone, Clifton, both of N.J.

[73] Assignee: Westinghouse Electric Corp., Pittsburgh, Pa.

[21] Appl. No.: 857,475

[22] Filed: Dec. 5, 1977

[51] Int. Cl.[2] ..... H01K 1/18; H01K 1/50

[52] U.S. Cl. ..... 313/273; 313/221; 313/222; 313/223; 313/276; 313/279

[58] Field of Search ..... 313/221, 222, 223, 273, 313/276, 279

[56] References Cited

U.S. PATENT DOCUMENTS

| | | | |
|---|---|---|---|
| 2,140,977 | 12/1938 | Allen | 313/276 |
| 3,644,776 | 2/1972 | DeCaro | 313/276 X |
| 3,648,094 | 3/1972 | DeCaro et al. | 313/221 |
| 3,727,091 | 4/1973 | DeCaro | 313/222 |
| 3,760,217 | 9/1973 | Martin et al. | 313/276 |
| 3,986,067 | 10/1976 | De Fraeye | 313/273 |
| 4,023,060 | 5/1977 | Pike et al. | 313/273 |

*Primary Examiner*—Alfred E. Smith
*Assistant Examiner*—Charles F. Roberts
*Attorney, Agent, or Firm*—D. S. Buleza

[57] ABSTRACT

The planar multi-coil filament of a high-wattage halogen-cycle incandescent lamp is suspended within the envelope by a mount assembly having support rods that are fastened to the lead-in conductors, the ends of the filament and the insulating bridge members by mechanical means rather than metal-to-metal welds. The mechanical junctures are effected by providing a coiled portion on one of the components and then crimping or hot-clamping it around the inserted part of the other component. The expense and quality control problems encountered with tungsten-to-tungsten and molybdenum-to-tungsten welds in the prior art halogen-cycle lamps are thus eliminated. Lamp cost is further reduced by fabricating the envelope from a selected hard glass and, in the case of lamps having large planar filaments, distortion of the filament coiled sections is prevented by modifying the mount structure to provide a "floating bridge" action.

5 Claims, 2 Drawing Figures

HALOGEN-CYCLE TYPE INCANDESCENT LAMP

BACKGROUND OF THE INVENTION

1. Field of the Invention

This invention relates to the electric lamp art and has particular reference to improved halogen-cycle incandescent lamps of high-wattage rating that are adapted for studio lighting and similar applications.

2. Description of the Prior Art

Incandescent lamps which contain a suitable halogen such as iodine or bromine that returns vaporized tungsten to the filament and thus increases both the life and efficacy of the lamp are well known in the art. Such so-called halogen-cycle type lamps are made in a variety of sizes and ranges. The functional advantages provided by the interaction between the tungsten filament and the halogen atmosphere are especially important in high-intensity light sources such as projection lamps used in film-viewing apparatus, studio lighting lamps, etc. However, the planar multi-coil filaments employed in such lamps, coupled with the use of a halogen atmosphere, require filament mount assemblies which are not only rugged but made of materials which will not be chemically attacked by the halogen and can thus withstand the harsh environment and elevated temperatures to which they are subjected. The metal components of the mounts are accordingly composed of tungsten and molybdenum and in the prior art lamps are usually fastened to each other and to the lead wires by welding them to one another.

A tungsten-halogen projection lamp having an envelope that is composed of borosilicate glass rather than quartz and which contains a filament mount assembly that is secured to the lead-in wires by a number of spot-welded bracing wires is disclosed in U.S. Pat. No. 3,648,094, issued Mar. 7, 1972 to DeCaro and Rainone, the authors of the present invention. A bromine-filled bipost type lamp containing a modified mount structure that is welded to the filament and has an envelope which is composed of high-temperature resistant aluminosilicate glass is disclosed in U.S. Pat. No. 3,644,776, issued Feb. 22, 1972 to DeCaro.

According to a more recent development in the manufacture of high-wattage tungsten-halogen type lamps, a planar filament is held in place within a quartz envelope by a pair of tubular bridge members composed of alumina that are slotted to receive a pair of tungsten lead-in rods and are immovably fastened to such rods by a series of interposed compressive coils. The lead-in rods serve as vertical supports and their free ends are seated in protruding cavities formed in the top wall of the envelope to rigidify the mount structure. A lamp having these features is disclosed in U.S. Pat. No. 4,023,060, issued May 10, 1977 to Pike et al.

A projection lamp which does not employ a halogen cycle but has a filament mount structure with welded junctures and a movable lower bridge assembly that provides a "floating bridge" action which accommodates the thermal expansion and contraction of the filament coil sections is disclosed in U.S. Pat. No. 2,140,977, issued Dec. 20, 1938 to H. E. Allen. A tubular halogen-cycle lamp containing a bridgeless mount assembly that is secured to a single axially-disposed coiled filament by coiled portions formed on the ends of the mount components which threadably engage or are hot-clamped to spud wires or coiled connector elements is disclosed in U.S. Pat. No. 3,760,217, issued Sept. 18, 1973 to Martin et al. A studio lighting lamp of the non-halogen variety having a pair of planar filaments that are held in place by a pair of spaced conjoined mount assemblies utlizing bridge members, cross-beams, and one-piece leads that are anchored in seals formed at the ends of tubular extensions of the lamp envelope is disclosed in U.S. Pat. No. 3,986,067, issued Oct. 12, 1976 to De Fraeye.

SUMMARY OF THE INVENTION

While the prior art lamps were generally satisfactory from a functional or operational standpoint, they left much to be desired from a manufacturing standpoint since they required complex mount structures and a large number of components that were difficult to make and assemble on a mass production basis, or necessitated the welding of metal components composed of either tungsten or molybdenum. As is well known to those skilled in the art, tungsten-to-tungsten and molybdenum-to-tungsten welds are very difficult to make and control insofar as such metals become brittle and crystallized when heated during the welding operation with the result that the welded juncture can be easily fractured if unduly stressed. Such welds thus require highly-skilled labor and are unreliable, particularly when made under mass-production conditions or the finished lamps are subjected to sharp impacts or shocks during shipment or when being handled.

In accordance with the present invention, a very inexpensive halogen-cycle type incandescent lamp of the projection and studio-lighting variety is provided by utilizing a filament-mount assembly of simple but rugged design having lead-in wire and other components that can be assembled and securely fastened together quickly in an assembly-line operation without any welds or fusion heating of the metal parts. This is accomplished by utilizing lead-in wires, a planar filament and bridge subassemblies that are provided with coiled portions which are merely slipped over a pair of substantially straight support rods and are mechanically fastened to the latter by either a crimping or hot-clamping operation. The mount assembly thus requires a minimum number of readily manufactured parts that are fastened to each other and to the lamp lead-in wires and planar filament in an efficient reliable manner without the need of any welds. To further reduce the cost of the lamp, the envelope is made from a hard glass such as borosilicate glass or aluminosilicate glass, which can withstand the halogen atmosphere and elevated temperatures involved, and is sealed in a stem composed of the same type glass.

BRIEF DESCRIPTION OF THE DRAWING

A better understanding of the invention will be obtained from the exemplary embodiment shown in the accompanying drawing, wherein.

DESCRIPTION OF THE PREFERRED EMBODIMENT

While the invention can be advantageously employed in halogen-cycle type lamps of various ratings and sizes that contain planar filaments, it is especially adapted for use in high-wattage bipost lamps designed for studio lighting and has accordingly been so illustrated and will be so described.

Figure 1:
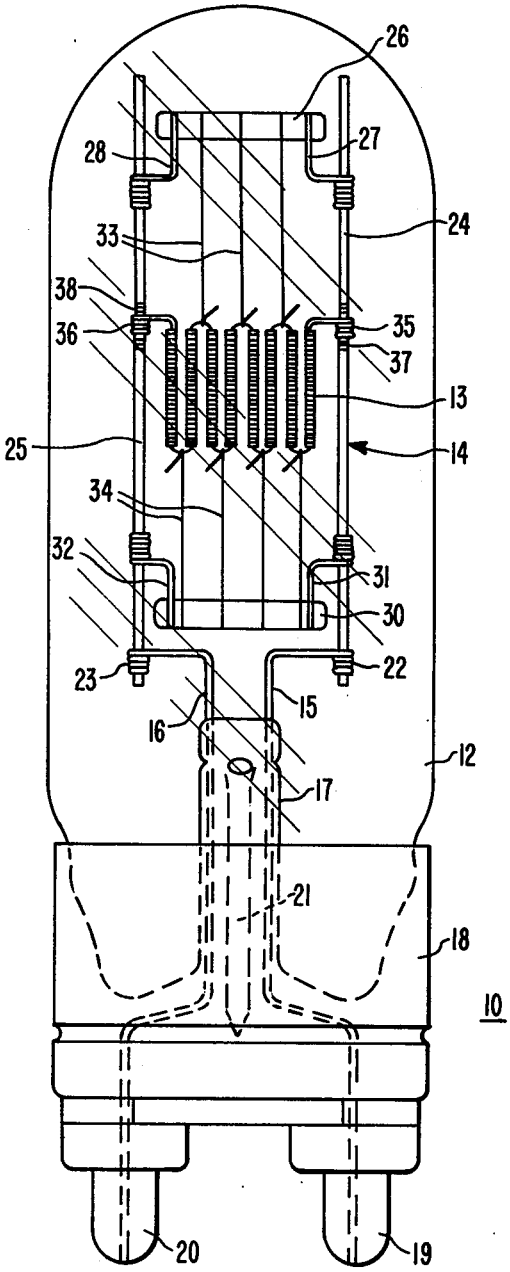
FIG. 1 is an elevational view of a halogen-cycle bipost type incandescent lamp which embodies the invention and is adapted for studio lighting and similar applications.

As shown in FIG. 1, the improved lamp 10 includes the usual light-transmitting envelope 12 that is preferably of tubular configuration and contains a planar type tungsten wire filament 13 having a plurality of uniformly spaced coiled sections that are joined by uncoiled segments of the filament wire. The planar filament 13 (which can be of the monoplane or biplane type) is held in central position within the envelope 12 by a mount assembly 14 which is fastened to a pair of rigid lead-in wires 15 and 16 that are composed of tungsten and are sealed through a glass stem 17 that is fused to the envelope in the usual manner. A base member 18 is secured to the sealed end of the envelope 12 and carries a pair of hollow metal pins or thimbles 19, 20 that are electrically connected to the outer ends of the lead-in wires.

The envelope 12 is evacuated and then filled with a suitable inert gas (such as nitrogen or the like at a pressure of about 900 torr) and dosed with a halogen-containing additive through a glass tubulation 21 which is then sealed off in the usual manner. Either iodine or bromine, or mixtures thereof, are preferred as the halogen and can be provided during lamp operation by dosing the lamp 10 with a measured amount of a suitable thermally-decomposable additive such as hydrogen bromide, tin tetraiodide or methylene bromide.

As will be noted, the mount assembly 14 is mechanically secured to the tungsten lead-in wires 15 and 16 by forming the ends of the wires into helically coiled portions 22 and 23 that are slipped over and either crimped or hot-clamped to the ends of a pair of substantially straight tungsten rods 24, 25 that comprise the upstanding support components of the mount. The lead-in wires 15 and 16 are flared outwardly from one another (as shown in FIG. 1) and are disposed on opposite sides of the stem 17 to enable the planar filament 13 to fit between the support rods with sufficient clearance.

The support rods 24, 25 are held in substantially parallel relationship with one another by a top bridge member 26 and a bottom bridge member 30 that are composed of quartz and have their ends fastened to the support rods by pairs of molybdenum wire connectors 27–28 and 31–32, respectively, that are anchored in the bridge members. A plurality of auxiliary support wires 33 and 34 composed of molybdenum are also anchored in the bridge members and coupled to the uncoiled wire segments of the planar filament 13, thus holding the coiled sections of the filament under slight tension and preventing them from sagging. The filament 13 is provided with coiled legs 35 and 36 that are hot-clamped around slip coils 37 and 38 which are force-fitted over the support rods 24, 25. Each of the wire connectors 27, 28, 31, and 32 are terminated by helically-coiled portions that are slipped over and either crimped or hot-clamped to the associated support rods.

All of the main components of the mount assembly 14 are thus electrically connected to one another, and to the planar filament 13 and lead-in conductors 15 and 16 solely by mechanical means without the need for any welding operations or intense heating of the metal parts. The tungsten-to-tungsten and tungsten-to-molybdenum welds that would otherwise be required are thus eliminated.

Figure 2:
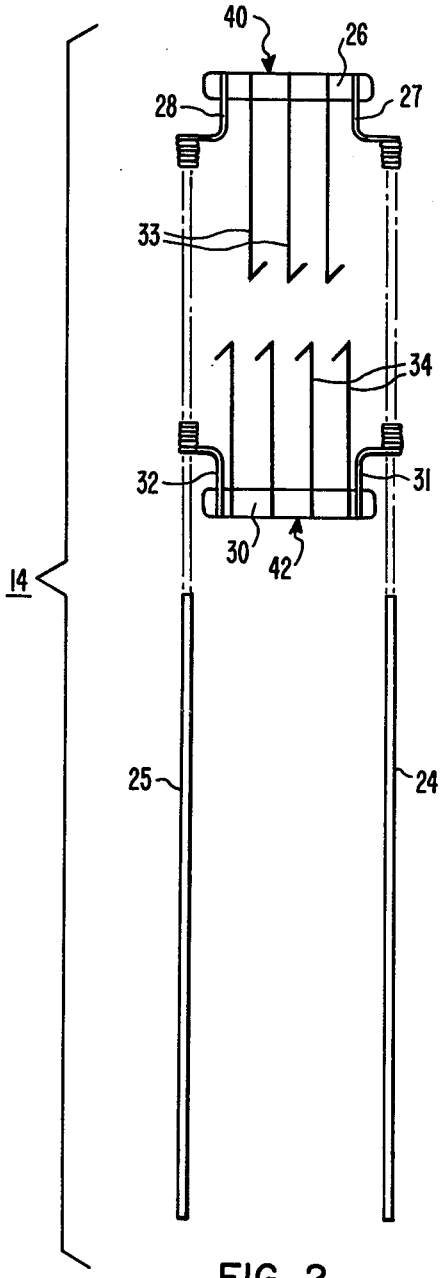
FIG. 2 is an exploded view of the mount components.

As shown in FIG. 2, in manufacturing the lamp 10 the various components of the mount assembly 14 are first combined to form a top bridge subassembly 40 and a lower bridge subassembly 42 that are then simply slip-fitted over the straight support rods 24 and 25 and mechanically locked in place by crimping or hot-clamping the coiled terminal portions of the wire connectors 27, 28, 31 and 32. The slip coils 37, 38 and coiled legs 35, 36 of the planar filament 13 (not shown) are slipped over the support rods before the top bridge subassembly 40 is inserted into position.

In the case of lamps having planar filaments 13 with long coiled sections, it is desirable to provide a slip fit between the coiled connectors 31, 32 of the lower bridge assembly 42 to permit the latter to move and provide a "floating bridge" action which accommodates the thermal expansion and contraction of the individual coil sections of the filament which occurs when the lamp 10 is energized and deenergized. This prevents the coiled sections from becoming distorted and possibly coming in contact with one another and causing a short circuit.

In accordance with the present invention, the cost of the halogen-cycle lamp 10 is reduced to a minimum by using the above-described simplified weld-free mount assembly 14 in combination with an envelope 12 that is composed of a selected hard glass rather than quartz. Suitable hard glasses are borosilicate glass and aluminosilicate glass, both of which are well known in the art.

Borosilicate glass has a softening temperature of about 820° C. and is marketed by the Corning Glass Company under the trade designation "Pyrex" No. 7740 Glass. A typical composition consists of about 80% silica, about 14% boric oxide, about 4% soda ($Na_2O$), and about 2% alumina.

Aluminosilicate glass is also marketed by the Corning Glass Company and a typical composition includes about 55% silica, about 22% alumina, about 13% magnesia, about 5% CaO, and about 5% boric oxide. It has a softening temperature of about 915° C.

We claim as our invention:

1. A halogen-cycle type incandescent lamp comprising;

a sealed light-transmitting envelope of vitreous material, a pair of rigid lead-in wires extending into said envelope and terminated by helically-coiled segments, an inert fill gas and a tungsten wire filament within said envelope, said filament being of planar configuration and having a plurality of coiled sections that are joined by uncoiled segments of the filament wire, means within said envelope for providing a halogen atmosphere in the lamp during the operation thereof, and a mount assembly holding the planar filament in a predetermined position within the envelope and comprising (a) a pair of substantially straight support rods extending along opposite sides of the planar filament, (b) a pair of insulating bridge members extending transversely between said support rods and defining therewith a frame-like structure that surrounds the planar filament, (c) coupling components fastening the support rods to the ends of said bridge members, and (d) auxiliary support wires anchored in said bridge members and engaging the said uncoiled wire segments of the filament, each of said coupling components comprising a rigid metal wire member having one end anchored in the associated bridge member and its other end terminated by a coiled segment that encircles and mechanically grips the associated support rod, said planar filament having coiled leg portions that encircle and are mechanically secured to said support rods, and the ends of said support rods extending through and being mechanically gripped by the coiled terminating segments of said lead-in wires so that said mount assembly, lead-in wires and bridge members are held in operative relationship with one another solely by mechanical means without any welds or fusion-type junctures of the metal components.

2. The halogen-cycle type incandescent lamp of claim 1 wherein the coupling members of one of said bridge members effects a slip-fit with the support rods which permits that bridge member and its auxiliary support wires to move relative to the planar filament and thus compensate for thermal expansion and contraction of the coiled sections of the filament which occurs when the lamp is energized and deenergized.

3. The halogen-cycle type incandescent lamp of claim 1 wherein;

said halogen atmosphere comprises iodine, bromine or mixtures thereof in vaporized form, said envelope is composed of a hard glass from the group consisting of borosilicate glass and aluminosilicate glass, said support rods and lead-in wires are composed of tungsten, and said auxiliary support wires and coupling members are composed of molybdenum.

4. The halogen-cycle type incandescent lamp of claim 3 wherein;

said bridge members are each composed of quartz, and said lead-in wires are sealed through a stem that is fused to and composed of the same type of hard glass as the envelope.

5. The halogen-cycle type incandescent lamp of claim 4 wherein;

said support rods are disposed in substantially parallel relationship, and said lead-in wires are flared outwardly from each other so that the helically-coiled terminating segments thereof are located on opposite sides of the stem and aligned with said support rods.

* * * * *